US006971771B2

(12) United States Patent
Hosaka

(10) Patent No.: US 6,971,771 B2
(45) Date of Patent: Dec. 6, 2005

(54) DISPLAY UNIT AND GAME MACHINE SYSTEM

(75) Inventor: Toshiyuki Hosaka, Matsumoto (JP)

(73) Assignee: Seiko Epson Corporation, (JP)

( * ) Notice: Subject to any disclaimer, the term of this patent is extended or adjusted under 35 U.S.C. 154(b) by 210 days.

(21) Appl. No.: 10/608,822

(22) Filed: Jun. 27, 2003

(65) Prior Publication Data

US 2004/0052078 A1 Mar. 18, 2004

(30) Foreign Application Priority Data

Jun. 28, 2002 (JP) ..... 2002-191085
Mar. 24, 2003 (JP) ..... 2003-080723

(51) Int. Cl.[7] ..... F21V 9/00
(52) U.S. Cl. ..... 362/293; 362/268; 463/20
(58) Field of Search ..... 362/293, 268; 353/34, 37, 48, 49; 463/20, 46, 30; 273/121 B

(56) References Cited

U.S. PATENT DOCUMENTS 5,767,924 A * 6/1998 Hiroki et al. ..... 349/5
6,049,364 A * 4/2000 Takahara et al. ..... 349/10

FOREIGN PATENT DOCUMENTS

| | | |
|---|---|---|
| JP | 62-250475 | 10/1987 |
| JP | 04-120884 | 4/1992 |
| JP | 09-159985 | 6/1997 |
| JP | 2000-214529 | 8/2000 |
| JP | 2002-214707 | 7/2002 |

OTHER PUBLICATIONS

Communication from Japanese Patent Office re: counterpart application.

* cited by examiner

*Primary Examiner*—Ali Alavi
(74) *Attorney, Agent, or Firm*—Harness, Dickey & Pierce, P.L.C.

(57) ABSTRACT

A display unit is provided capable of reducing the generation of heat due to a light source. There are provided a light source lamp, light dividing mirrors for dividing incident light emitted by the light source lamp, and a plurality of projector units capable of modulating the divided incident light to incident light and projecting the incident light to game boards to display images. With such an arrangement, images can be displayed on a plurality of game machines with the single light source lamp, and thus the number of light sources can be reduced in the entire game system, which reduces the entire amount of heat generated by the light source lamp.

7 Claims, 14 Drawing Sheets

DISPLAY UNIT AND GAME MACHINE SYSTEM

BACKGROUND

1. Technical Field of the Invention

The present invention relates to a display unit capable of projecting incident light to a screen to display an image and to a game machine system.

2. Description of the Related Art

Japanese Unexamined Utility Model Registration Application Publication No. 7-24381 discloses a pachinko (pachinko machine) capable of projecting a game image onto a translucent optical-image display of a front panel using a rear-projector (display unit). In this case, the projector includes a liquid crystal display and a light source lamp, wherein a projection lens is arranged between the projector and the front panel. In the pachinko machine, first, the projector passes light emitted from the light source lamp through the liquid crystal display to modulate it to an optical image (projection light) and emits it. The projection lens then magnifies the projection light emitted by the projector and projects it to the translucent optical-image display of the front panel. In this manner, a game image is projected on the translucent optical-image display.

The above display unit and pachinko machine have the following problems: The pachinko machine projects various images to a front panel using light emitted from a light source lamp built in a display unit. In such a case, the light source lamp generates a large quantity of heat during lights-on time. Therefore, it is necessary for the pachinko machine to provide a radiator such as a radiator fan to release the generated heat out of the pachinko machine in order to avoid the effects of the generated heat to a controller and the like. On the other hand, in pachinko parlors, generally, a plurality of pachinko machines is arranged in the form of an "island" (a plurality of pachinko machines is arranged in a line at the back of a plurality of pachinko machines arranged side by side). Therefore, there is the possibility that the inside of the "island" of the pachinko machines is filled with heat released from the pachinko machines to decrease the reliability of the pachinko machines or to impair the environment of the pachinko parlor. Also, the pachinko machine has an individual light source lamp and radiator, thus offering a problem of an increased price of the pachinko machine resulting from the cost of the parts and installation. Furthermore, the light source lamp is replaced periodically to prevent burn-out during a game. In this case, the pachinko machine has the light source lamp built in the display unit, thus posing a problem of requiring a long time for complicated replacement work.

The present invention has been made in consideration of the above problems. Accordingly, it is one object of the invention to provide a display unit and a game machine system capable of reducing the generation of heat due to a light source. It is another object to provide a game machine system which can be constructed at low cost and can reduce the replacement time for the light source.

SUMMARY

In order to attain the above objects, a display unit according to the present invention comprises a light source, light dividing means for dividing light emitted by the light source, and a plurality of modulation means which modulates the divided light to projection light capable of respectively displaying an image and projects the projection light to a screen to display the image.

In the display unit according to the invention, preferably, the light dividing means includes a plurality of reflectors corresponding to the respective modulation means, wherein the reflectors are arranged on the optical path of the light emitted by the light source to reflect the emitted light toward the corresponding modulation means.

In the display unit according to the invention, preferably, each of the reflectors is an integrated unit of a reflecting section for reflecting part of the emitted light toward the corresponding modulation means and a through-beam section for passing other part of the emitted light through other reflectors arranged apart from the light source.

In the display unit according to the invention, preferably, the light dividing means includes a plurality of prisms arranged corresponding to the respective modulation means, wherein the prisms are arranged on the optical path of the light emitted by the light source to change the optical path of the emitted light toward the respective modulation means.

In the display unit according to the invention, preferably, the light dividing means includes a plurality of optical fibers capable of guiding the light emitted by the light source to the respective modulation means.

A game machine system according to the invention comprises the display unit and a plurality of game machines each having the screen.

The display unit and the game machine system include a light source, light dividing means for dividing light emitted by the light source, and modulation means which modulates the divided light to incident light and projects the projection light to a screen to display an image, thus displaying images on a plurality of game machines with one light source, and thus decreasing the number of the light sources in the entire game machine system. Consequently, the entire amount of heat generated by the light source can be reduced. Also, the installation of the individual light source and radiator in each game machine becomes unnecessary, allowing the game machine system to be constructed at low cost. Also, since the number of the light sources can be decreased in the entire game machine system, the time for replacing the light source can be reduced correspondingly.

Also, since the light dividing means includes a plurality of reflectors each reflecting the emitted light toward the modulation means, the emitted light can be divided with a simple structure, which minimizes the display unit. Also, since each of the reflectors is an integrated unit of a reflecting section for reflecting part of the emitted light and a through-beam section for passing part of the emitted light, the emitted light can be divided and reflected with one reflector for each modulation means. Also, since the display unit includes a plurality of prisms that changes the optical paths of the emitted light toward the respective modulation means, the emitted light can be uniformly divided for each modulation means. Furthermore, since the display unit includes a plurality of optical fibers capable of guiding the emitted light to the respective modulation means, the divided light can be guided to the game machines arranged in arbitrary positions.

DETAILED DESCRIPTION

Preferred embodiments of a display unit and a game machine system according to the present invention will be described with reference to the drawings.

Figure 1:
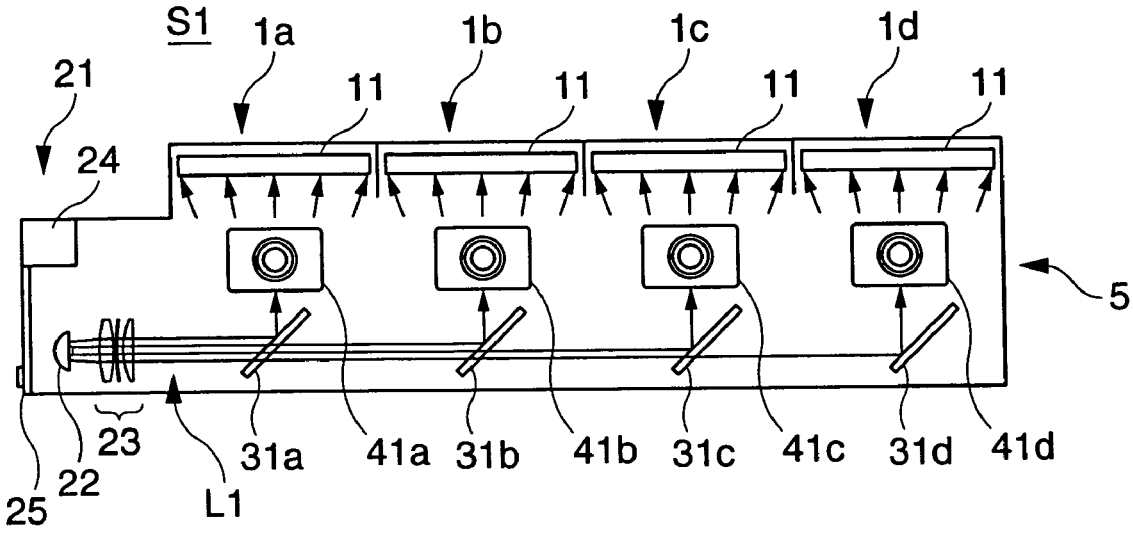
FIG. 1 is a schematic plan view of a pachinko system S1 according to an embodiment of the present invention.
Figure 2:
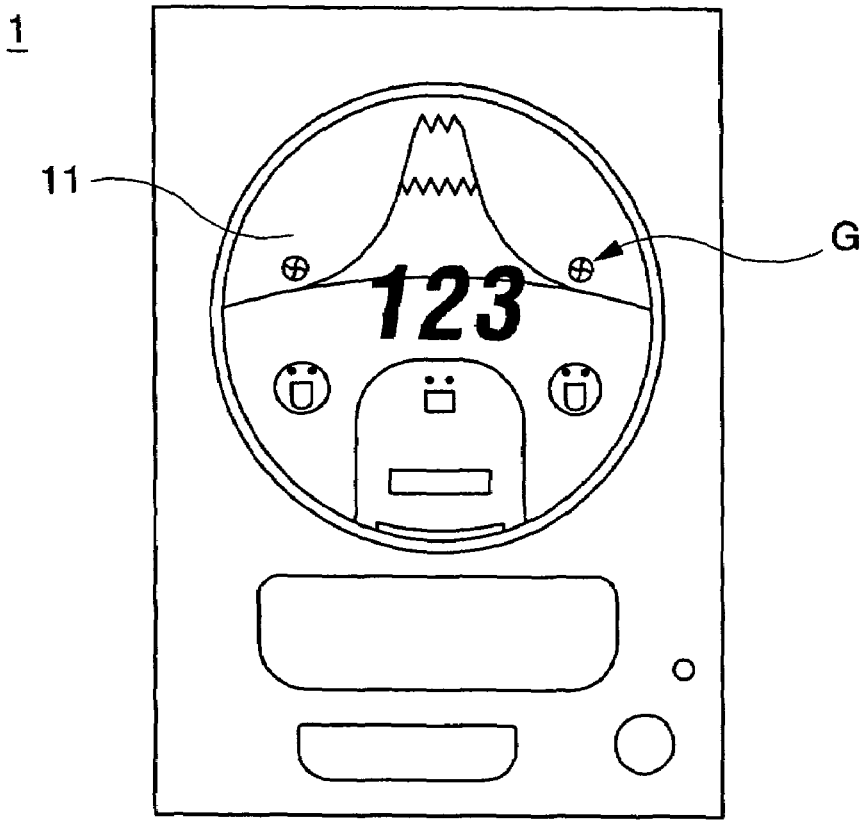
FIG. 2 is a schematic front view of a pachinko machine 1.
Figure 3:
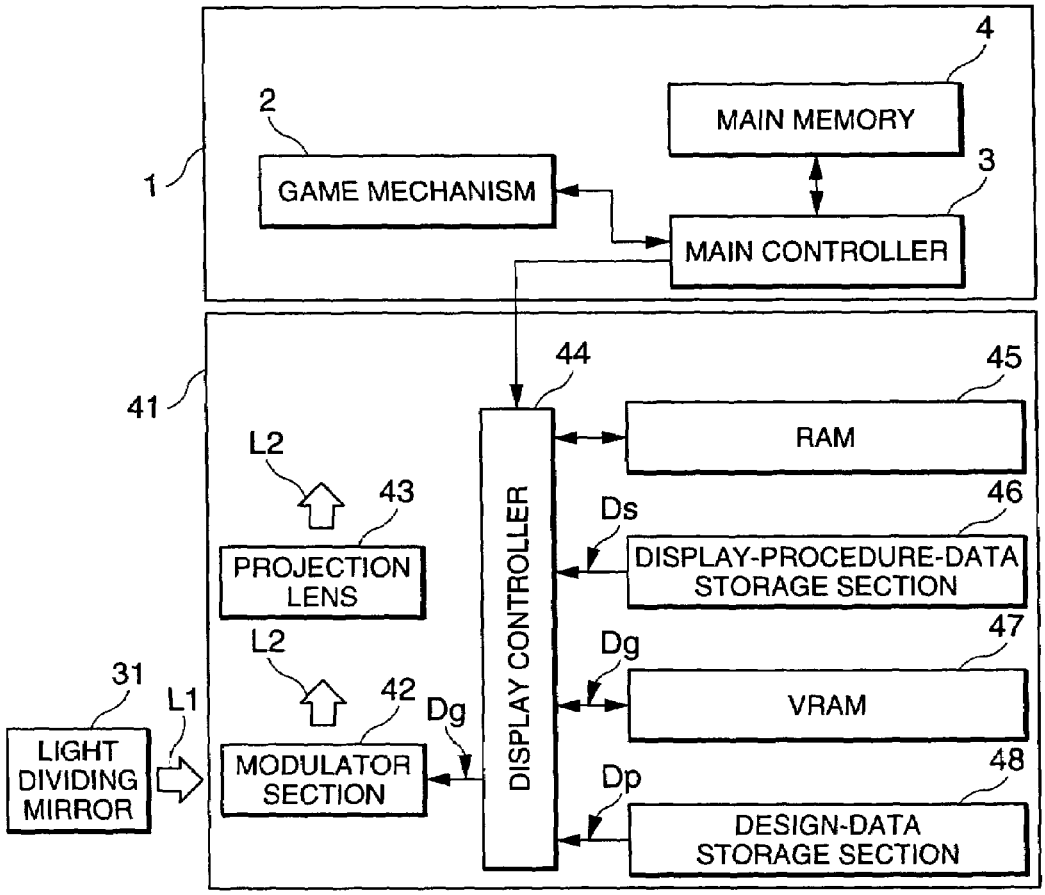
FIG. 3 is a block diagram principally showing the arrangement of the pachinko machine and a projector unit.

The arrangement of a pachinko system S1 will first be described with reference to the drawings. As shown in FIG. 1, the pachinko system (game machine system) S1 includes N (for example, four) pachinko machines (game machines) 1*a* to 1*d* (hereinafter, also referred to as pachinko machines 1 when not distinguished) arranged in a line and a display unit 5 arranged behind (at the back of) the pachinko machines 1 for displaying an image on each game board 11 of the pachinko machines 1 by projecting it from the back. Each of the pachinko machines 1 is a standalone machine that can be operated in isolation, which can display a display image G (such as the ground, Mt. Fuji, and numerals "123" in the drawing), which is projected by the display unit 5, on the surface of the game board 11, as shown in FIG. 2. More specifically, the pachinko machine 1 includes a game mechanism 2, a main controller 3, and a main memory 4, as shown in FIG. 3.

Figure 4:
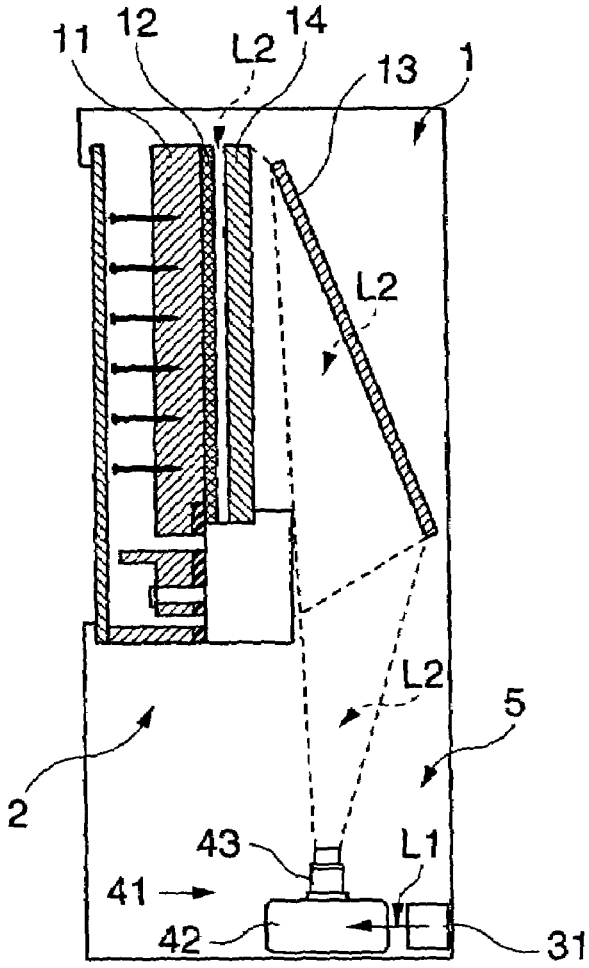
FIG. 4 is a schematic sectional side view of the pachinko machine and a display unit.

The game mechanism 2 includes the game board 11, a screen film (screen) 12, a projection mirror 13, and a Fresnel lens 14, as shown in FIG. 4. The entire game board 11 is formed of an optically transparent resin, having a plurality of pins and accessories fixed to the surface. The screen film 12 is adhered to the back of the game board 11. The screen film 12, for example, receives and disperses projection light L2 emitted from a projector unit 41 to form the display image G (FIG. 2). The projection mirror 13 is arranged at the back of the game board 11, reflecting the projection light L2 emitted by the projector unit 41 of the display unit 5, which will be described later, toward the screen film 12. The Fresnel lens 14 is arranged between the projection mirror 13 and the screen film 12, converting the projection light L2 emitted by the projector unit 41 to parallel rays of light (parallel rays of light in a broad sense) and projecting it to the screen film 12. The main controller 3 centrally controls the pachinko machines 1 and outputs various commands that correspond to the state of the game to the display unit 5 to allow various image display processing, thereby allowing various images to be displayed. The main memory 4 stores the operation program of the main controller 3.

The display unit 5 includes a light source unit 21, light dividing mirrors (reflectors) 31*a* to 31*d* (hereinafter, also referred to as "light dividing mirrors 31" when not distinguished), and projector units 41*a* to 41*d* (hereinafter, also referred to as "projector units 41" when not distinguished), as shown in FIG. 1. The light source unit 21 is arranged, for example, at one end of the display unit 5 (on the left in FIG. 1) and emits incident light (emission light) L1 toward the light dividing mirror 31*a*. More specifically, the light source unit 21 includes a light source lamp (light source) 22 which is an integrated unit of a light emitting section and a hemispherical reflecting mirror, condensing lenses 23 for condensing light emitted by the light source lamp 22 to emit the incident light beam L1, and a radiator fan 24 for radiating heat generated by the light source lamp 22. The light source unit 21 has a door 25 for maintenance on the side thereof, in which the light source lamp 22 can easily be replaced through the opened door 25.

Figure 5:
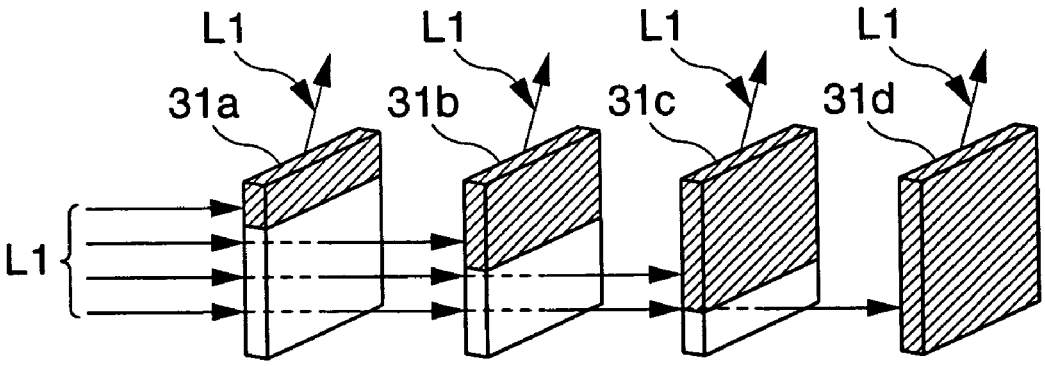
FIG. 5 is a perspective view of the arrangement of light dividing mirrors of the display unit.

The light dividing mirrors (reflectors) 31*a* to 31*d* constitute light dividing means in the present invention, corresponding to the projector units 41. More specifically, as shown in FIG. 5, each of the light dividing mirrors 31*a* to 31*d* is formed in the shape of a rectangular plate as a whole, being capable of reflecting the incident light L1 emitted by the light source unit 21. In this case, each of the light dividing mirrors 31*a* to 31*d* is an integrated unit of a reflecting section (a diagonally shaded area in the drawing) for reflecting part of the incident light L1, and a transmitting section (through-beam section) for passing other part of the incident light L1 through the other light dividing mirrors 31 which are arranged apart from the light source lamp 22. The light dividing mirrors 31*a* to 31*c* have different area ratios between the reflecting section and the transmitting section. More specifically, for example, the light dividing mirror 31*a* has the reflecting section that is one quarter of the whole above the transmitting section that is three-quarters of the whole; the light dividing mirror 31*b* has the reflecting section that is a half of the whole above the transmitting section that is a half of the whole; and the light dividing mirror 31*c* has the reflecting section that is three-quarters of the whole above the transmitting section that is one quarter of the whole, as shown in the same drawing.

Furthermore, as shown in FIG. 1, each of the light dividing mirrors 31*a* to 31*d* are arranged on the optical path of the incident light L1 with, for example, a 45 degree slant relative to the optical path. With such an arrangement, each of the light dividing mirrors 31*a* to 31*d* divides one quarter of the incident light L1 and reflects it toward each projector unit 41, as shown in the drawing. In this case, the material of the transmitting section may be glass or an optically transparent resin. The transmitting section is not particularly necessary but a mirror formed of only the reflecting section may be fixed to a frame. The light division of the invention means light division in a broad sense, which is not a concept of spectral factorization of light. More specifically, the light division of the invention means that, for example, the incident light L1 is distributed to four positions.

As shown in FIG. 3, the projector unit 41 includes a modulator section (modulation means) 42, a projection lens 43, a display controller 44, a RAM 45, a display-procedure-data storage section 46, a VRAM 47, and a design-data storage section 48. In this case, the projector unit 41 is arranged below the projection mirror 13 in the pachinko machine 1, as shown in FIG. 4. The modulator section 42 includes, for example, a liquid crystal light valve having a liquid crystal panel, an incident-side polarizing plate, and an irradiation-side polarizing plate. In this case, the modulator section 42 modulates the incident light L1 (white light) reflected by the light dividing mirror 31 to the image-projecting projection light L2 (light that is shaded and colored according to the display image G) which can display, for example, the display image G shown in FIG. 2 on the basis of a display image data Dg outputted by the display controller 44 and emits it. The projection lens 43 is integrated with the modulator section 42, emitting the incident light L2 which is emitted by the modulator section 42 in magnification toward the projection mirror 13.

The display controller 44 is a controller only for image display, performing various image processing in accordance with various commands outputted by the main controller 3 to produce the display image data Dg for allowing the display image G to be displayed. The RAM 45 temporarily stores various data produced by the display controller 44. The display-procedure-data storage section 46 stores display procedure data Ds in which the design to be used for each image, the display position of the display image G when the image is displayed in a static or moving picture, and size are written and the operation program for the display controller 44. The VRAM 47 stores the display image data Dg produced by the display controller 44. The design-data storage section 48 stores various design data Dp (data such as the ground, Mt. Fuji, and numerals) for producing the display image data Dg.

The overall operation of the pachinko system S1 will be described with reference to the drawings. In the pachinko system S1, the light source lamp 22 emits light by the power-on of the light source unit 21, and the condensing lenses 23 condense the light and emit the incident light beam L1 toward the light dividing mirror 31*a*, as shown in FIG. 1. At that time, the radiator fan 24 starts up to release the air inside the light source unit 21, which is heated by the light source lamp 22, to the exterior. Subsequently, as shown in FIG. 5, the reflecting section of the light dividing mirror 31*a* reflects about one quarter of the incident light L1 toward the modulator section 42 of the projector unit 41*a,* and the transmitting section allows about three-quarters of the incident light L1 to pass through. Then, the reflecting section of the light dividing mirror 31*b* reflects about one-third of the incident light L1 that has passed through the light dividing mirror 31*a* (about one quarter of the incident light L1 at the time of emission) toward the modulator section 42 of the pachinko machine 1*b,* and the transmitting section allows about two-thirds of the incident light L1 that has passed through the light dividing mirror 31*a* (about a half of the incident light L1 at the time of emission) to pass through. The reflecting section of the light dividing mirror 31*c* reflects about half of the incident light L1 that has passed through the light dividing mirror 31*b* (about one quarter of the incident light L1 at the time of emission) toward the modulator section 42 of the pachinko machine 1*c,* and the transmitting section allows about half of the incident light L1 that has passed through the light dividing mirror 31*b* (about one quarter of the incident light L1 at the time of emission) to pass through. Furthermore, the light dividing mirror 31*d* reflects the incident light L1 that has passed through the light dividing mirror 31*c* (about one quarter of the incident light L1 at the time of emission) toward the modulator section 42 of the pachinko machine 1*d*. Accordingly, the incident light L1 emitted by the light source unit 21 is divided into about one quarter by the light dividing mirrors 31*a* to 31*d* and is reflected toward the respective modulator sections 42 of the pachinko machines 1*a* to 1*d*.

On the other hand, when the pachinko machines 1 are turned on, the main controller 3 first outputs a command for displaying the display image G shown in FIG. 2, and correspondingly, the display controller 44 reads the display procedure data Ds designated by the command from the display-procedure-data storage section 46. The display controller 44 then reads design data Dp, Dp and so on, which are necessary to produce display image data Dg for displaying the display image G, from the design-data storage section 48. Then, the display controller 44 virtually renders a design that corresponds to the design data Dp, Dp and so on on the virtual plane of the VRAM 47, thereby producing the display image data Dg in the VRAM 47. Subsequently, the display controller 44 outputs the display image data Dg in the VRAM 47 to the modulator section 42. The modulator section 42 then modulates the incident light L1 reflected by the light dividing mirror 31 to the projection light L2 for image projection on the basis of the display image data Dg, and emits it. The projection lens 43 in turn projects the emitted projection light L2 in magnification toward the projection mirror 13 and the projection mirror 13 reflects the projection light L2 toward the screen film 12. At that time, the projection light L2 reflected by the projection mirror 13 passes through the Fresnel lens 14, thereby being converted to parallel rays of light and projected to the screen film 12. Accordingly, the projection light L2 is imaged by the screen film 12, and so the display image G shown in FIG. 2 is displayed on the board of the game board 11.

In this manner, the display unit 5 and the pachinko system S1 are equipped with the light source unit 21, the plurality of light dividing mirrors 31 for dividing the incident light L1 emitted by the light source unit 21, and the plurality of projector units 41 capable of modulating the divided incident light L1 to the projection light L2 and projecting the modulated projection light L2 to the screen film 12 to thereby display an image. Accordingly, an image can be displayed on each of the plurality of pachinko machines 1 with one light source lamp 22, reducing the number of the light source lamps 22 in the entire pachinko system S1, and thus reducing the amount of heat generated by the light source lamp 22 as a whole. Also, the installation of the individual light source and radiator to each pachinko machine 1 becomes unnecessary, allowing the pachinko system S1 to be constructed at low cost.

Also, since the number of the light source lamps 22 in the entire pachinko system Si can be reduced, the time for replacing the light source lamp 22 can be reduced correspondingly. According to the display unit 5 and the pachinko system S1, the display unit 5 includes the light dividing mirrors 31*a* to 31*d* for reflecting the incident light L1 to each of the modulator sections 42, simplifying the light dividing means for the incident light L1, and thus reducing the size of the display unit 5. Furthermore, according to the display unit 5 and the pachinko system S1, the light dividing mirrors 31*a* to 31*c* are formed of an integrated unit of the reflecting section for reflecting part of the incident light L1 toward the modulator section 42 and the transmitting section for passing part of the incident light L1 therethrough. Therefore, the incident light L1 can be divided and reflected by one light dividing mirror 31 for each modulator section 42.

Figure 6:
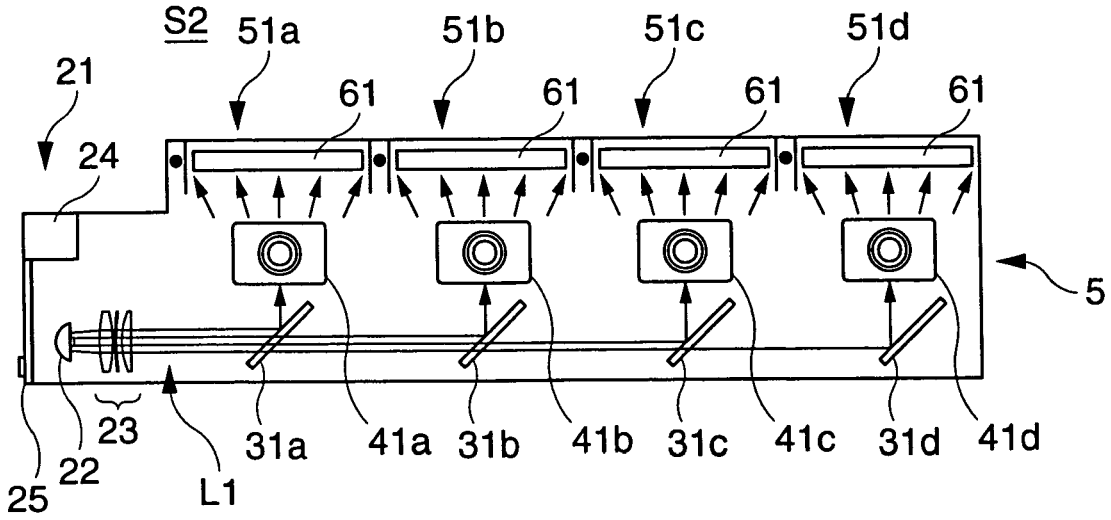
FIG. 6 is a schematic plan view of a slot machine system according to another embodiment.
Figure 7:
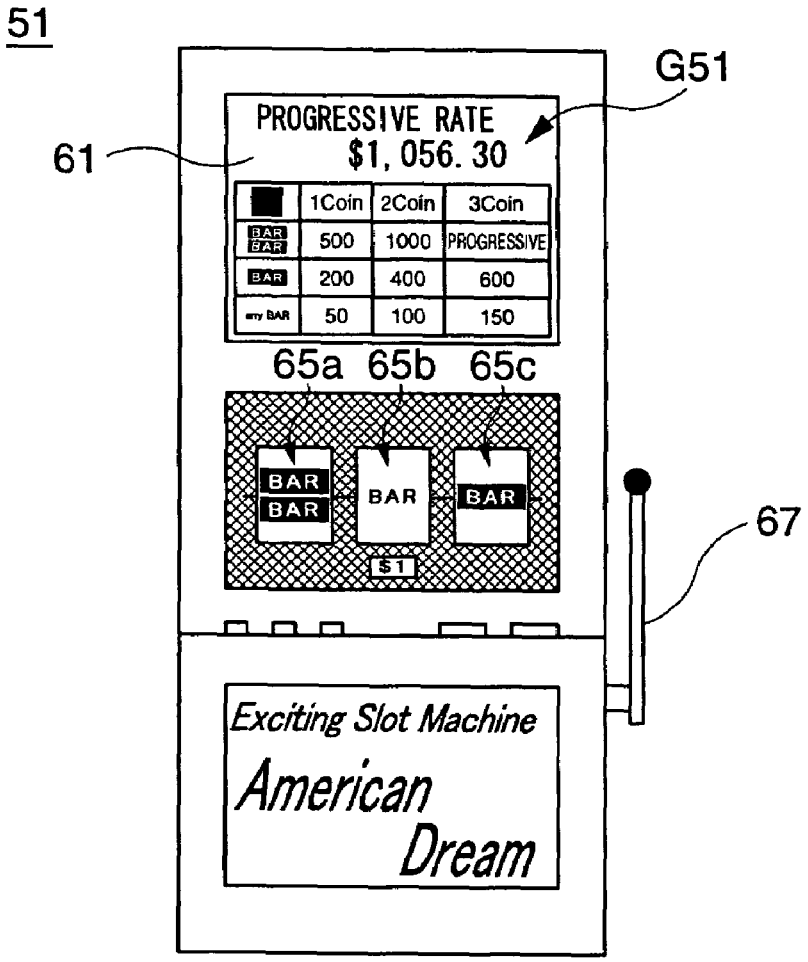
FIG. 7 is a schematic front view of a slot machine.
Figure 8:
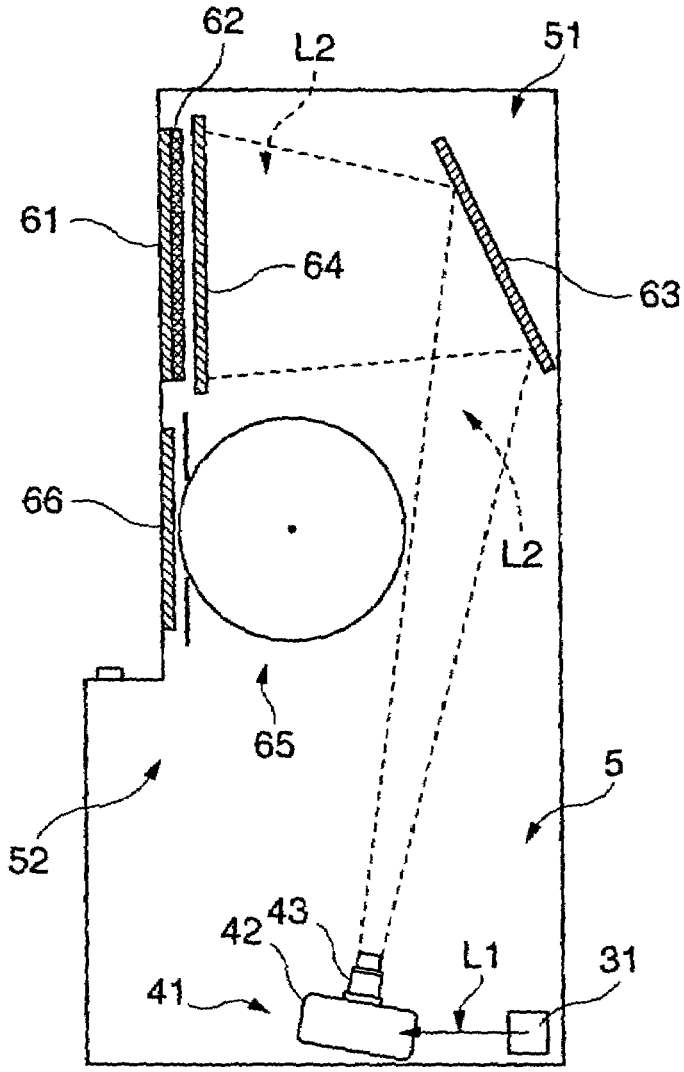
FIG. 8 is a schematic sectional side view of the slot machine and the display unit.

A slot machine system S2 according to another embodiment of the invention will next be described with reference to the drawings. The slot machine system S2 and a pinball machine system S3, which will be described later, incorporate the present invention principally, as in the pachinko system S1. Therefore, the same components as those of the pachinko system S1 will be given the same numerical designations and a repeated description thereof will be omitted. The slot machine system S2 includes, for example, four slot machines 51*a* to 51*d* arranged in a line (hereinafter, also referred to as "slot machines 51" when not distinguished) and the display unit 5, as shown in FIG. 6. Each of the slot machines 51 is a standalone machine that can be operated in isolation, which can display a display image G51 (such as an image showing the amount of a money reward in the drawing) that is projected by the display unit 5 on the surface of a game board 61, as shown in FIG. 7. The slot machine 51 includes a game mechanism 52, as shown in FIG. 8. The game mechanism 52 includes the game board 61, a screen film 62, a projection mirror 63, a Fresnel lens 64, and a reel 65. The reel 65 includes three cylindrical reels 65*a* to 65*c* (refer to FIG. 7) having a plurality of designs thereon, which is arranged at the back of a glass plate 66 formed in the center of the front face of the machine body, as shown in FIG. 8. In this case, the reels 65*a* to 65*c* stop after a plurality of rotations in accordance with the operation of a handle 67 (refer to FIG. 7).

In the slot machine system S2, when the light source unit 21 is turned on, the light source unit 21 emits the incident light beam L1 toward the light dividing mirror 31*a* as in the pachinko system S1. At that time, the incident light L1 is divided into about one quarter by the light dividing mirrors 31*a* to 31*d*, and is reflected toward the respective projector units 41 of the slot machines 51*a* to 51*d*, as shown in FIG. 6. On the other hand, when the slot machines 51 are turned on, the main controller 3 outputs a command for displaying the display image 51G shown in FIG. 7 and the display controller 44 outputs the display image data Dg to the modulator section 42. The modulator section 42 then modulates the incident light L1 reflected by the light dividing mirrors 31 to the projection light L2 for image projection based on the display image data Dg and emits it, and the projection lens 43 magnifies the projection light L2. At that time, the projection light L2 is reflected by the projection mirror 63 and passes through the Fresnel lens 64, thereby being converted to parallel rays of light and projected to the screen film 62, as shown in FIG. 8. Thus, the display image G51 is displayed on the surface of the game board 61, as shown in FIG. 7.

In this manner, also in the slot machine system S2, providing the display unit 5 allows an image to be displayed on each of the plurality of slot machines 51 with the single light source lamp 22, thereby reducing the number of the light source lamps 22 in the entire slot machine system S2, and thus reducing the amount of heat generated by the light source lamp 22 as a whole. Also, the installation of the individual light source and radiator to each slot machines 51 becomes unnecessary, allowing the slot machine system S2 to be constructed at low cost.

Figure 10:
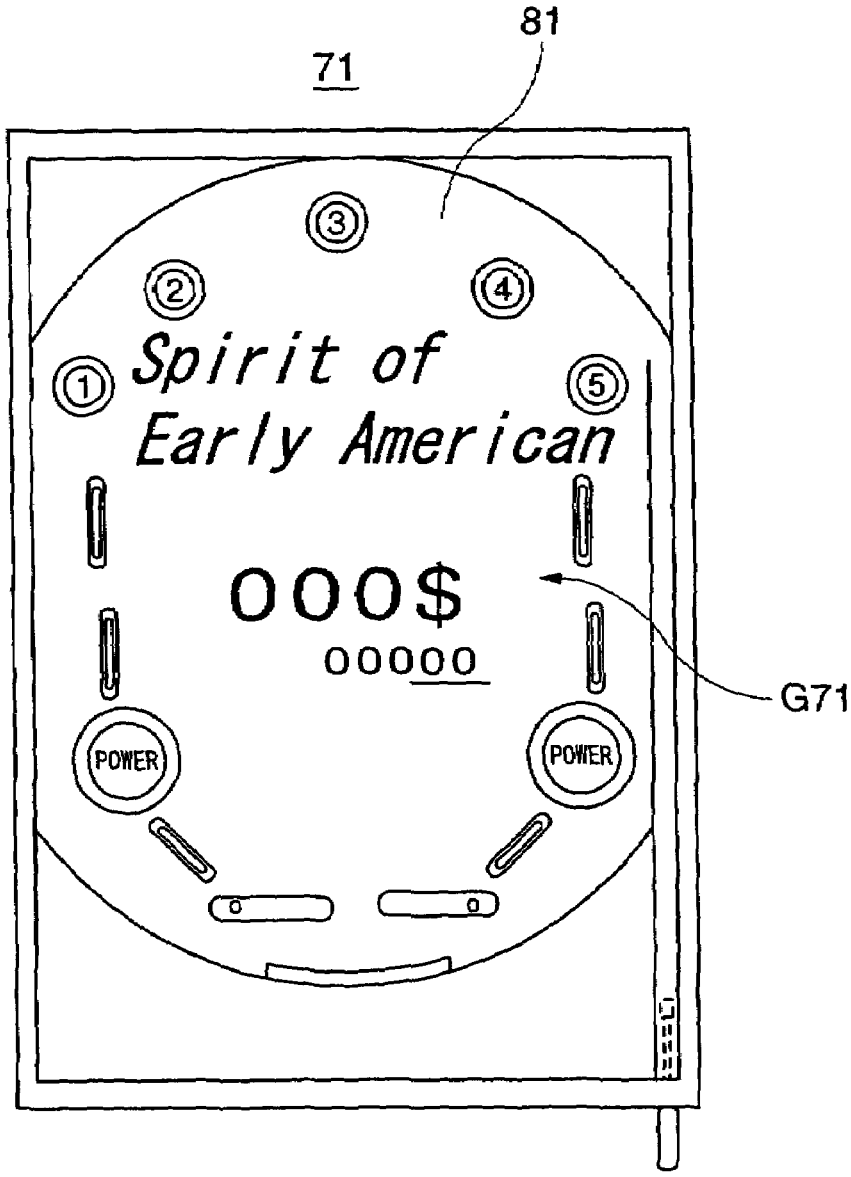
FIG. 10 is a schematic front view of a pinball machine.
Figure 11:
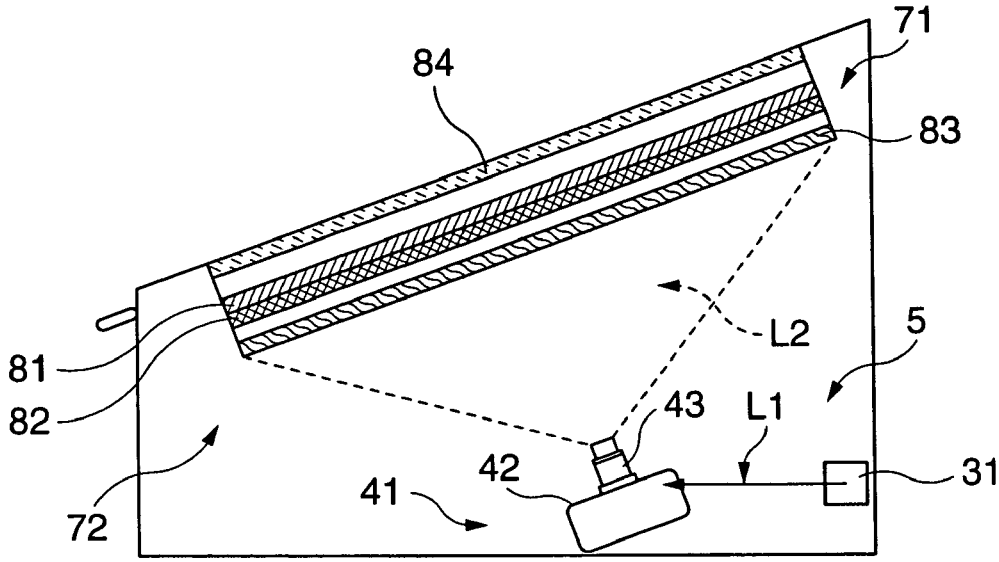
FIG. 11 is a schematic sectional side view of the pinball machine and the display unit.

The game machine system according to the invention is not limited to the pachinko system S1 and the slot machine system S2 but includes a pinball machine system having a pinball machine. For example, a pinball machine system S3 shown in FIG. 9 includes four pinball machines 71*a* to 71*d* arranged in a line (hereinafter, also referred to as "pinball machines 71" when not distinguished) and the display unit 5. Each of the pinball machines 71 is a standalone machine that can be operated in isolation, which can display a display image G71 (such as images showing the title (name of machine type) and the points obtained shown in the drawing) that is projected by the display unit 5 on the surface of a game board 81, as shown in FIG. 10. The pinball machine 71 includes a game mechanism 72, as shown in FIG. 11. The game mechanism 72 includes the game board 81 having various accessories, which is formed of an optically transparent resin and is arranged on the top of the machine body, a screen film 82 adhered to the back of the game board 81, and a Fresnel lens 83. In this case, in each of the pinball machines 71, a ball is moved between the game board 81 and a glass plate 84 disposed on the top of the machine body, so that the pinball game is performed.

Figure 9:
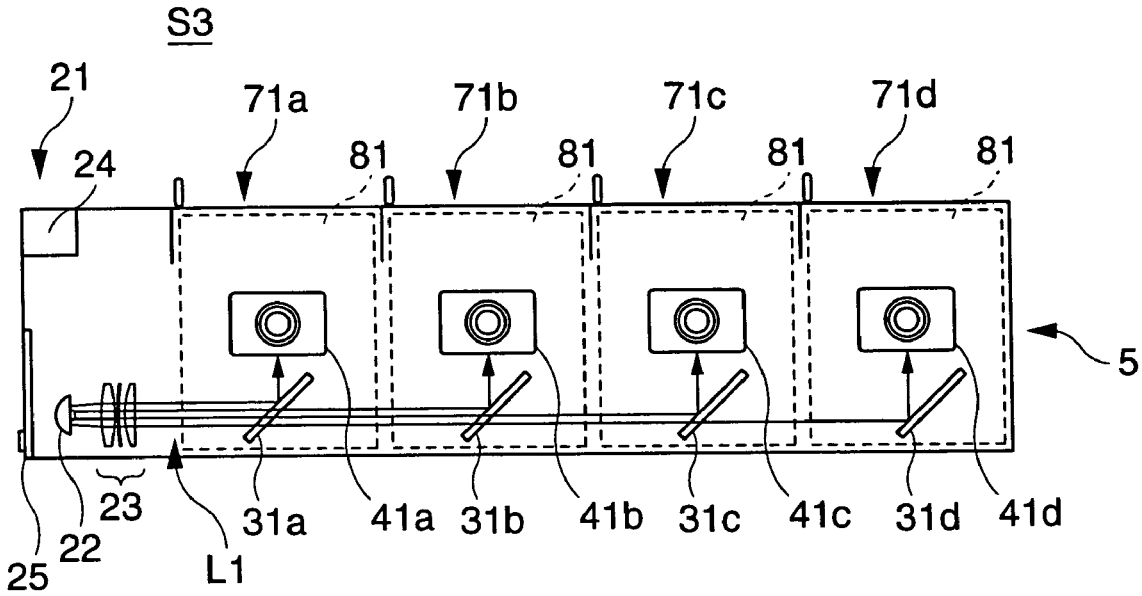
FIG. 9 is a schematic plan view of a pinball machine system according to another embodiment.

In the pinball machine system S3, when the light source unit 21 is turned on, the incident light L1 is divided and reflected toward the respective projector units 41 of the pinball machines 71*a* to 71*d* in the same way as the pachinko system S1, as shown in FIG. 9. On the other hand, when the pinball machines 71 are turned on, the main controller 3 outputs a command for displaying the display image 71G shown in FIG. 10 and the display controller 44 outputs the display image data Dg to the modulator section 42. The modulator section 42 then emits the projection light L2 for image projection based on the display image data Dg and the projection lens 43 magnifies the projection light L2. At that time, the projection light L2 passes through the Fresnel lens 83, thereby being converted to parallel rays of light and being projected to the screen film 82, as shown in FIG. 11. Thus, the display image G71 is displayed on the surface of the game board 81, as shown in FIG. 10. As described above, also in the pinball machine system S3, providing the display unit 5 reduces the number of the light source lamps 22 in the entire pinball machine system S3, thus reducing the amount of heat generated by the light source lamp 22 as a whole. Also, the installation of the individual light source and radiator to each of the slot machines 71 becomes unnecessary, allowing the pinball machine system S3 to be constructed at low cost.

Figure 12:
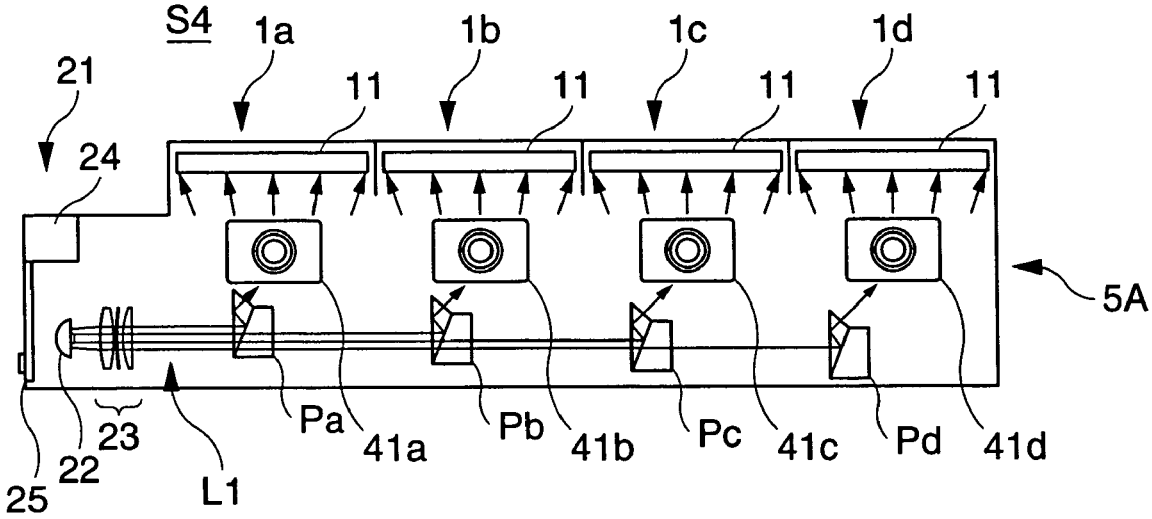
FIG. 12 is a schematic plan view of a pachinko system according to another embodiment.

The invention is not limited to the aforesaid embodiments of the invention. For example, in the embodiments of the invention, while the light dividing means of the invention has been described taking the display unit 5 equipped with the light dividing mirrors 31*a* to 31*d* as an example, the structure of the light dividing means is not limited to that. For example, as shown in FIG. 12, a pachinko system S4 equipped with a display unit 5A may be constructed, which has, for example, four prisms Pa to Pd capable of changing the optical path of the incident light L1, in place of the light dividing mirrors 31*a* to 31*d*. In this case, the prisms Pa to Pd are constructed so as to divide, for example, one quarter of the incident light L1 and to change the optical path toward the projector units 41*a* to 41*d*. According to the pachinko system S4, the display unit 5A includes the prisms as the light dividing means, allowing the incident light L1 to be divided to almost one quarter, and thus allowing the incident light L1 to be divided equally to the modulator sections 42.

Figure 13:
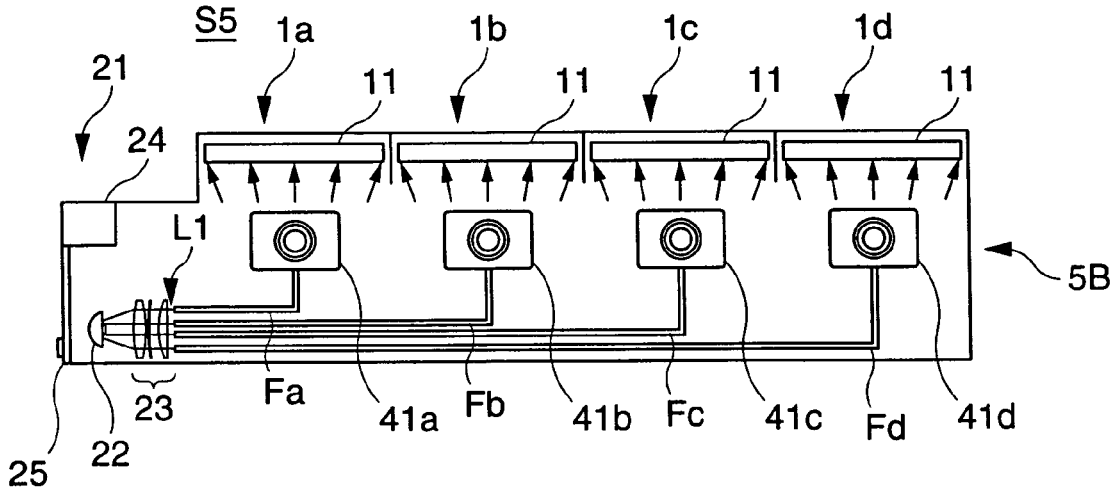
FIG. 13 is a schematic plan view of a pachinko system according to another embodiment.

As shown in FIG. 13, a pachinko system S5 equipped with a display unit 5B may be constructed, which includes, for example, four flexible optical fibers Fa to Fd in place of the light dividing mirrors 31*a* to 31*d*. In this case, the respective input terminals of the optical fibers Fa to Fd are fixed to the outputs of the condensing lenses 23. The condensing lenses 23 are constructed so as to uniformly irradiate the respective input terminals of the optical fibers Fa to Fd with the collected incident light L1. Accordingly, the incident light L1 is divided into, for example, quarters by the optical fibers Fa to Fd in this case and is guided from the input terminals of the optical fibers Fa to Fd to the output terminals. On the other hand, the respective output terminals of the optical fibers Fa to Fd are fixed to positions at which the divided incident light L1 can be guided to the projector units 41*a* to 41*d*. Therefore, according to the pachinko system S5, since the optical fibers Fa to Fd are flexible, the divided incident light L1 can be guided to each of the pachinko machines 1 arranged in arbitrary positions.

Figure 14:
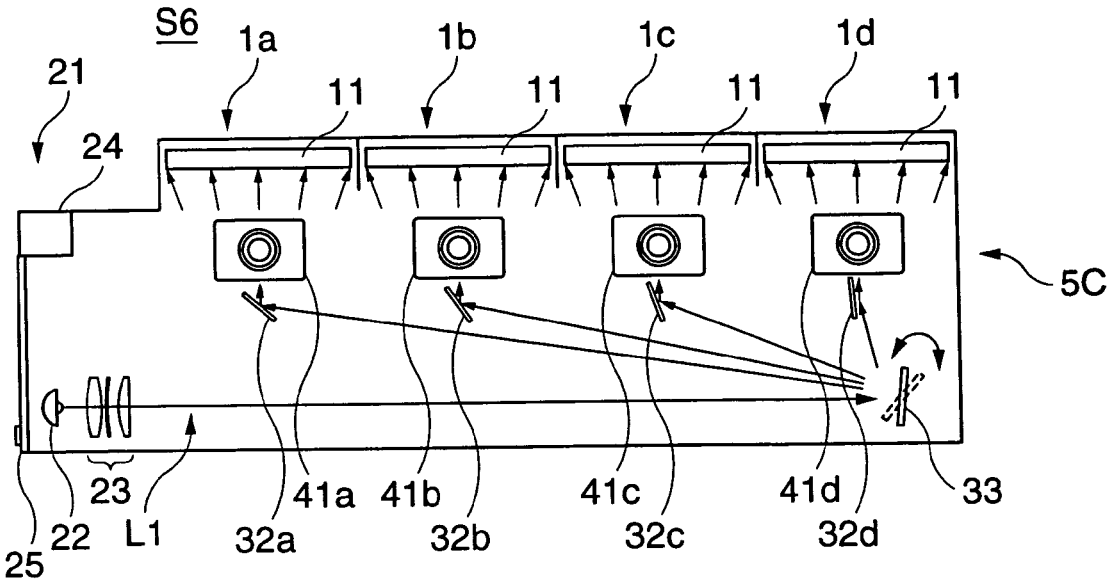
FIG. 14 is a schematic plan view of a pachinko system according to another embodiment.

The embodiments of the invention have been described taking the display unit 5 as an example in which the incident light L1 is reflected by one light dividing mirror 31 for each projector unit 41; however, it is also possible to employ a structure in which the incident light L1 is reflected by a plurality of mirrors for each projector unit 41. The light dividing mirror is not limited to a fixed type but may be a moving light-dividing mirror having a moving mechanism. For example, as shown in FIG. 14, a display unit 5C includes fixed mirrors 32*a* to 32*d* which are disposed so as to correspond to the respective projector units 41 and a moving mirror 33 capable of reflecting the incident light L1 toward the fixed mirrors 32*a* to 32*d* by switching the angle at a fixed time intervals. In a pachinko system S6 having the display unit 5C, the moving mirror 33 sequentially reflects the incident light L1 to the fixed mirrors 32*a* to 32*d* at intervals not to cause flicker, and the fixed mirrors 32*a* to 32*d* reflect the incident light L1 reflected by the moving mirror 33 to the projector units 41. Thus, images can be displayed to the plurality of pachinko machines 1 using the single light source lamp 22, and accordingly, the entire amount of heat generated by the light source lamp 22 can be reduced as in the pachinko system S1. It is also possible to construct a slot machine system and a pinball machine system equipped with either of the displays 5A to 5C in place of the display unit 5. Even with such structure, the same advantages as those of the pachinko systems S4 to S6 can be offered.

The embodiments of the invention have been described with an example in which the light source unit 21 has one light source lamp 22; however, it is also possible to construct the light source unit 21 having an auxiliary light source lamp 22. In this case, the light source unit 21 includes a lamp burnout sensor that outputs a lamp-burnout detection signal when the light source lamp 22 is burned out and switching means that switches to an auxiliary light source lamp in accordance with the lamp-burnout detection signal, thus providing a display, a pachinko system, a slot machine system, and a pinball machine system capable of instant switchover to the auxiliary light source lamp 22 in the event of burning out of the light source lamp 22. The embodiments of the invention have been described taking the pachinko system S1 including the four pachinko machines 1 as an example. The number of pachinko machines 1, however, is not limited to that; for example, the pachinko system may include two or more pachinko machines 1 and a display having light dividing means corresponding to that in number. Similarly, it is also possible to provide a slot machine system S2 including two or more slot machines 51 and a display having light dividing means corresponding to that in number and to provide a pinball machine system S3 including two or more pinball machines 71 and a display having light dividing means corresponding to that in number.

Furthermore, the embodiments of the invention have been described taking the projector unit 41 that is an integrated unit of the modulator section 42 and the projection lens 43 as an example; however, it is also possible to construct the modulator section 42 and the projection lens 43 separately, only the modulator section 42 being arranged near the condensing lenses 23 of the light source unit 21. In this case, after the incident light L1 has been divided by the light dividing mirrors 31, the prisms Pa to Pd, or the optical fibers Fa to Fd, the divided incident light L1 is modulated to the projection light L2 by each of the modulator section 42, and the modulated projection light L2 is guided to each projection lens 43 arranged below the projection mirror 13 by the mirrors and optical fibers. Thus, the same advantages as those of the pachinko system S1, the slot machine system S2, and the pinball machine system S3 can be offered.

The entire disclosure of Japanese Patent Application Nos. 2002-191085 filed Jun. 28, 2002 and 2003-080723 filed Mar. 24, 2003 are incorporated by reference.

What is claimed is:

1. A display comprising:

a light source;

light dividing means for dividing light emitted by the light source; and a plurality of modulation means which modulates the divided light to incident light capable of displaying an image and projects the incident light to a screen to display the image;

wherein the light dividing means includes a plurality of reflectors that correspond to the respective plurality of modulation means, the reflectors being arranged in an optical path of the light emitted by the light source to reflect the emitted light respectively toward the corresponding modulation means, and each of the reflectors being an integrated unit including a reflecting section for reflecting part of the emitted light toward the corresponding modulation means and a transmitting section for passing another part of the emitted light through other reflectors arranged apart from the light source.

2. The display according to claim 1, wherein the light dividing means includes a plurality of prisms arranged corresponding to the respective modulation means, the prisms being arranged on the optical path of the light emitted by the light source to change the optical path of the emitted light toward the modulation means.

3. The display according to claim 1, wherein the light dividing means includes a plurality of optical fibers capable of guiding the light emitted by the light source to the respective modulation means.

4. A game machine system comprising the display as set forth in claim 1 and a plurality of game machines each having the screen.

5. A display unit comprising:

a plurality of displays;

a plurality of modulators positioned to independently correspond with each of said plurality of displays;

a common light source emitting light to each of said plurality of and light directing means for directing at least part of said light to each of said plurality of modulators;

wherein said light directing means includes a plurality of light reflectors sequentially positioned along an optical path of said light, at least an upstream one of said plurality of light reflectors being partially transmissive.

6. The display unit of claim 5 wherein said light directing means further comprises:

a plurality of prisms sequentially positioned along an optical path of said light.

7. The display unit of claim 5 wherein said light directing means further comprises:

a plurality of optical fibers disposed between said light source and each of said plurality of modulators.

* * * * *